US010463902B2

(12) United States Patent
Yeh

(10) Patent No.: US 10,463,902 B2
(45) Date of Patent: Nov. 5, 2019

(54) MAGNETIC CONTROL EXERCISER

(71) Applicant: Yung-Sung Yeh, New Taipei (TW)

(72) Inventor: Yung-Sung Yeh, New Taipei (TW)

( * ) Notice: Subject to any disclaimer, the term of this patent is extended or adjusted under 35 U.S.C. 154(b) by 119 days.

(21) Appl. No.: 15/803,117

(22) Filed: Nov. 3, 2017

(65) Prior Publication Data

US 2019/0134449 A1 May 9, 2019

(51) Int. Cl.

| | |
|---|---|
| ***A63B 21/00*** | (2006.01) |
| ***A63B 21/22*** | (2006.01) |
| ***A63B 23/035*** | (2006.01) |
| ***A63B 23/12*** | (2006.01) |

(52) U.S. Cl.

CPC .. *A63B 21/00192* (2013.01); *A63B 21/00069* (2013.01); *A63B 21/153* (2013.01); *A63B 21/154* (2013.01); *A63B 21/157* (2013.01); *A63B 21/225* (2013.01); *A63B 21/4043* (2015.10); *A63B 23/03525* (2013.01); *A63B 23/1209* (2013.01); *A63B 21/4035* (2015.10); *A63B 2208/0233* (2013.01)

(58) Field of Classification Search

CPC ..... A63B 21/00; A63B 21/00; A63B 21/40
See application file for complete search history.

(56) References Cited

U.S. PATENT DOCUMENTS 4,199,139 A * 4/1980 Mahnke ..... A63B 21/06 482/101
4,798,378 A * 1/1989 Jones ..... A63B 21/0052 482/72
4,900,018 A * 2/1990 Ish, III ..... A63B 21/06 482/138
5,151,071 A * 9/1992 Jain ..... A63B 21/154 482/101
7,303,506 B1 * 12/2007 Reynolds ..... A63B 7/04 482/112
7,553,264 B2 * 6/2009 Carter ..... A63B 21/154 482/102
7,981,010 B1 * 7/2011 Webber ..... A63B 21/0615 482/100
8,025,608 B2 * 9/2011 Popescu ..... A63B 23/1209 482/111
8,162,807 B1 * 4/2012 Webber ..... A63B 21/0615 482/100
9,403,047 B2 * 8/2016 Olson ..... A63B 21/00192
9,656,116 B2 * 5/2017 Giannelli ..... A63B 21/063
10,213,639 B2 * 2/2019 Giannelli ..... A63B 21/063
(Continued)

*Primary Examiner* — Garrett K Atkinson
(74) *Attorney, Agent, or Firm* — Egbert Law Offices, PLLC

(57) ABSTRACT

A magnetic control exerciser includes a base, a pulley device and damping device respectively disposed on the base. A first rope is coiled on the pulley device, wherein a first handlebar and a second handlebar are respectively transversally connected to a first end and a second end of the first rope. A second rope has two opposite ends respectively connected to the pulley device and the damping device for providing a damping and promoting the effect of the magnetic control exerciser in accordance with the present invention. The first handlebar has an original horizontal height higher than that of the second handlebar for providing different exercising modes. A seat is secured on the base for user to easily operate the first handlebar and the second handlebar.

15 Claims, 6 Drawing Sheets

(56) References Cited

U.S. PATENT DOCUMENTS

| | | | | |
|---|---|---|---|---|
| 10,238,917 | B1 * | 3/2019 | Kojayan | A63B 24/0087 |
| 2003/0060345 | A1 * | 3/2003 | Piane, Jr. | A63B 21/154<br>482/100 |
| 2006/0264305 | A1 * | 11/2006 | Klassen | A63B 21/154<br>482/99 |
| 2008/0287270 | A1 * | 11/2008 | Carter | A63B 21/154<br>482/99 |
| 2009/0143202 | A1 * | 6/2009 | Carter | A63B 21/154<br>482/99 |
| 2010/0041520 | A1 * | 2/2010 | Popescu | A63B 21/015<br>482/37 |
| 2015/0182773 | A1 * | 7/2015 | Olson | A63B 21/00192<br>482/8 |
| 2016/0346590 | A1 * | 12/2016 | Giannelli | A63B 21/063 |
| 2017/0157449 | A1 * | 6/2017 | Giannelli | A63B 21/063 |
| 2018/0290006 | A1 * | 10/2018 | Giannelli | A63B 21/063 |
| 2019/0076691 | A1 * | 3/2019 | Smith | A63B 21/154 |

* cited by examiner

MAGNETIC CONTROL EXERCISER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an exerciser, and more particularly to a magnetic control exerciser.

2. Description of Related Art Including Information Disclosed Under 37 CFR 1.97 and 37 CFR 1.98

A conventional exerciser in accordance with the prior art usually provides a single function, particularly a weight training machine. Another problem of the conventional exerciser is the operating stroke. The operating stroke of the conventional exerciser is limited. The conventional exerciser uses a rope directly drawing a damping device and a fixed pulley to change the operating direction of the rope such that the stroke of the front end of the rope is equal to that of the rear end of the rope. However, the collecting length of the rope of the damping device is fixed. Consequently, the diameter of the counterweight flywheel must be enlarged for coiling a longer rope for lengthening the stroke of the conventional exerciser. As a result, the weight, the manufacturing cost and the transporting cost of the conventional exerciser are raised.

The conventional exercisers usually use a spring, a resilient rope or a counterweight to bidirectionally provide a great damping for promoting the training effect. However, this is incorrect. The operator must continually force to resist the restitution force from the spring, the resilient rope or the counterweight when releasing and backing the handlebar. This is very dangerous, particularly, when the operator is exhausted.

Furthermore, the conventional exerciser is unsuitable for a child or an older user. However, some conventional exercisers are provided for rehabilitation in hospitals. A bidirectionally forced exerciser may cause a counter-effect to the operator.

The present invention has arisen to mitigate and/or obviate the disadvantages of the conventional exercisers.

BRIEF SUMMARY OF THE INVENTION

The main objective of the present invention is to provide an improved magnetic control exerciser that effectively alters the stroke of the exercisers.

To achieve the objective, the magnetic control exerciser in accordance with the present invention comprises a base and a damping device disposed on the base, wherein an outputting damping value of the damping device is adjusted due to a magnetic control effect. A rope collecting device is disposed in the damping device, wherein a coiling force of the rope collecting device is smaller than the damping value of the damping device. A main frame is uprightly secured on the base and a pulley device is disposed on the base, wherein the pulley device includes a moving pulley. A first rope is coiled the pulley device. The first rope has a first end and a second, wherein a first handlebar is secured on the first end of the first rope and a second handlebar is secured on the second end of the first rope, and wherein the first handlebar has an original horizontal height higher than that of the second handlebar. The first handlebar/the second handlebar is automatically moved to its original due to the damping device and engaged to the main frame when the first handlebar/the second handlebar is idle. A second rope is connected to the moving pulley and the damping device, wherein the stroke of the moving pulley is only L/2 when the first handlebar/the second handlebar is pulled and has a stroke of L, and the second end/the first end of the first rope is fixed due to the second handlebar, and wherein the stroke of the second rope is halved and the operating stroke of the magnetic control exerciser is effectively promoted.

Further benefits and advantages of the present invention will become apparent after a careful reading of the detailed description with appropriate reference to the accompanying drawings.

DETAILED DESCRIPTION OF THE INVENTION

Figure 1:
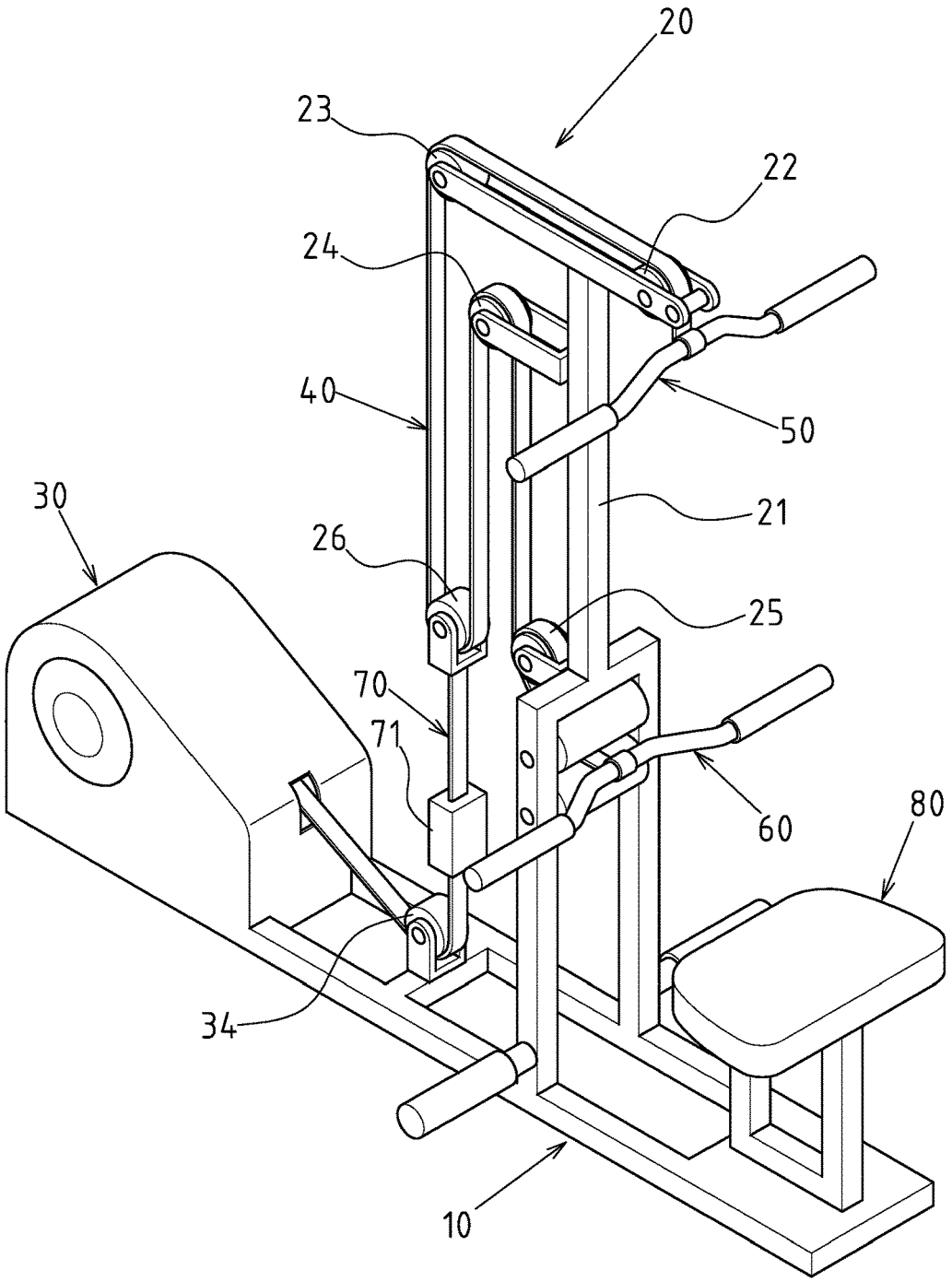
FIG. 1 is a perspective view of a magnetic control exerciser in accordance with the present invention.
Figure 2:
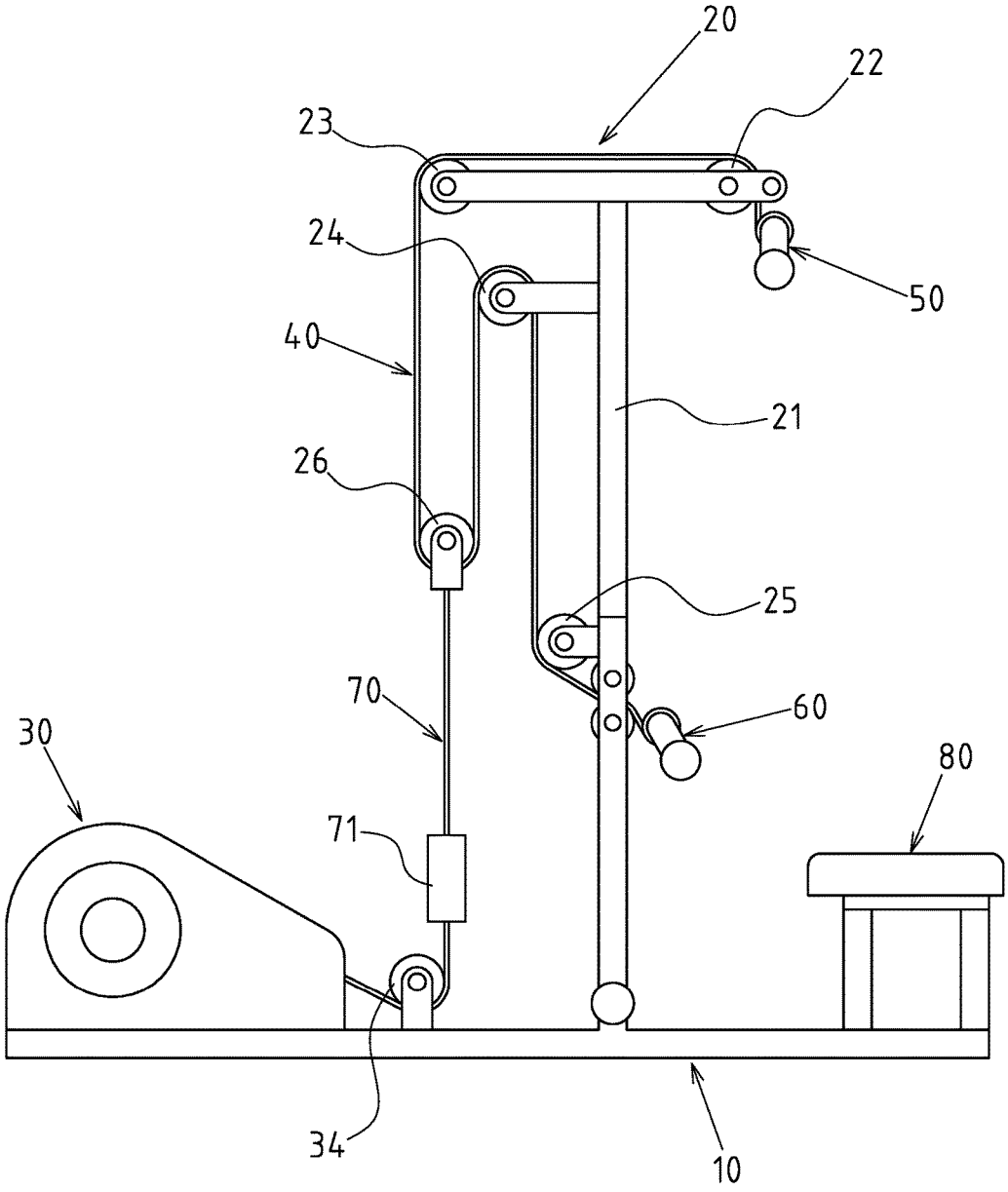
FIG. 2 is a side plan view of the magnetic control exerciser in FIG. 1 when in an original status.
Figure 3:
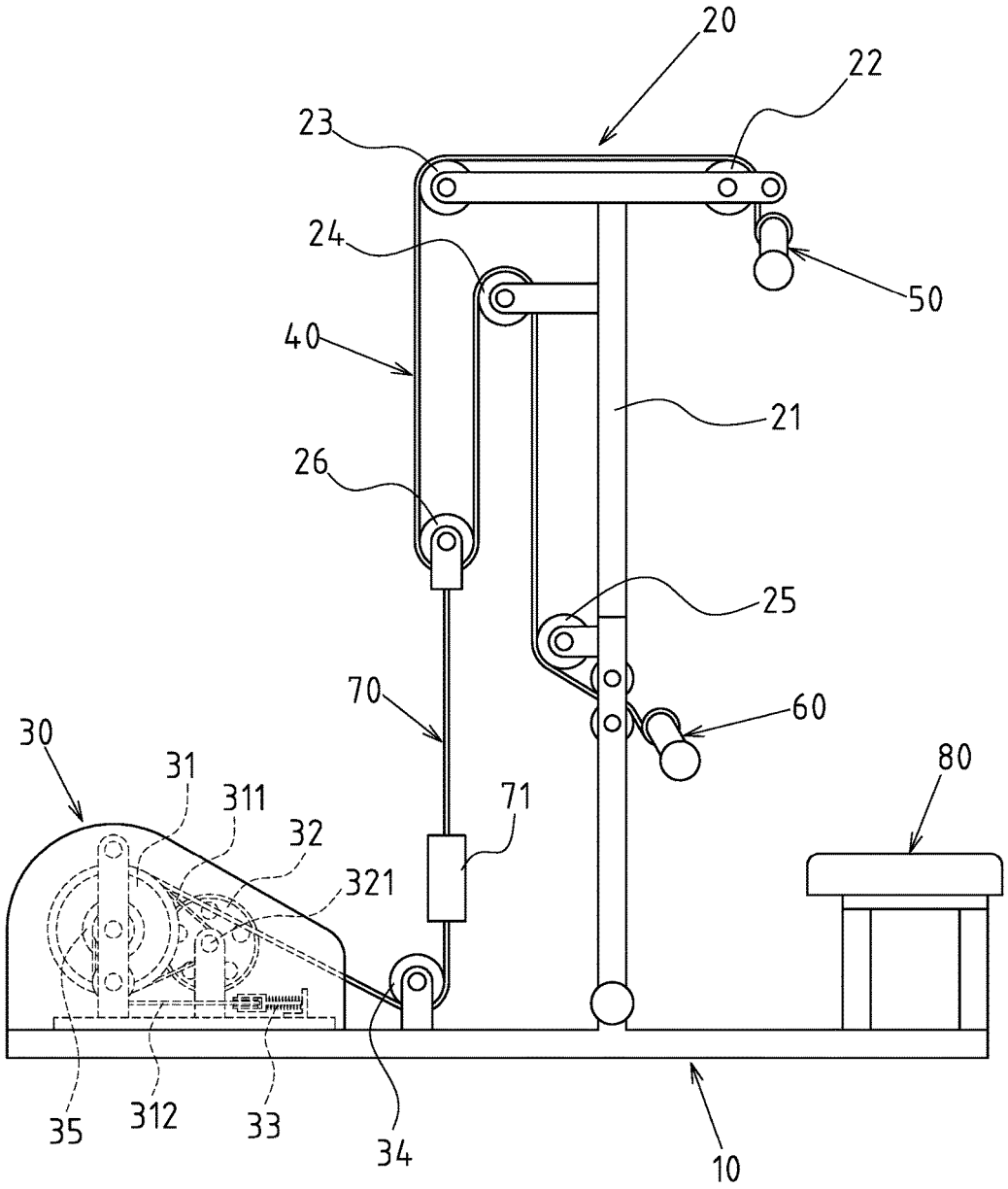
FIG. 3 is a side schematic view of a damping device of the magnetic control exerciser in accordance with the present invention.

Referring to the drawings and initially to FIGS. 1-3, a magnetic control exerciser in accordance with the present invention comprises base 10, a pulley device 20 and damping device 30 respectively disposed on the base 10. A first rope 40 is coiled on the pulley device 20, wherein a first handlebar 50 and a second handlebar 60 are respectively transversely connected to a first end and a second end of the first rope 40. A second rope 70 has a first end and a second end respectively connected to the pulley device 20 and the damping device 30 for providing a damping and promoting the effect of the magnetic control exerciser in accordance with the present invention. The first handlebar 50 has an original horizontal height higher than that of the second handlebar 60 for providing different exercising modes. A seat 80 is secured on the base 10 for user to easily operate the first handlebar 50 and the second handlebar 60.

The pulley device 20 includes a main frame 21 uprightly secured on the base 10, wherein the main frame 21 is situated between the seat 80 and the damping device 30. A first fixed pulley 22 and a second fixed pulley 23 are respectively rotatably mounted to two opposite ends of a top portion of the main frame 21. A third fixed pulley 24 and the fourth fixed pulley 25 are respectively rotatably mounted to a rear side of the main frame 21, wherein the third fixed pulley 24 and the fourth fixed pulley 25 respectively correspond to the first handlebar 50 and the second handlebar 60. The first rope 40 sequentially coils the first fixed pulley 22, the second fixed pulley 23, the third fixed pulley 24 and the fourth fixed pulley 25, wherein a moving pulley 26 is disposed between the second fixed pulley 23 and the third fixed pulley 24 on the first rope 40, wherein the first end of the second rope 70 is connected to the moving pulley 26. A counterweight 71 is disposed on the second rope 70 between the moving pulley 26 and the damping device 30. With reference to FIG. 3, the third fixed pulley 24 has a horizontal height lower than that of the first fixed pulley 22 and the second fixed pulley 23.

The outputting damping value of the damping device 30 is adjusted due to a magnetic control effect. The damping device 30 includes a counterweight flywheel 31 rotatably mounted on the base 10, a magnetic wheel 32 rotatably mounted on the base 10 and a resilient member 33 connected to the counterweight flywheel 31. The second end of the second rope 70 is secured on the counterweight flywheel 31 and coiled on the counterweight flywheel 31. The magnetic wheel 33 is rotated with the counterweight flywheel 31 via a belt 311. A rope collecting device 35 is laterally and centrally mounted onto the counterweight flywheel 31. The coiling force of the rope collecting device 35 is smaller than the damping value of the damping device 30. A rope 312 has a first end coiled on the rope collecting device 35 and a second connected to the resilient member 33, wherein the magnetic wheel 32 has a one-way bearing 321 centrally mounted therein. A fixed pulley 34 is disposed on the base 10. The fixed pulley 34 is provided to change the direction of the second rope 70, wherein the counterweight 71 is situated between the fixed pulley 34 and the moving pulley 26. The gravity of the counterweight 71 is greater than total gravity of the first handlebar 50 and the second handlebar 60 adding the total friction of the pulley device 20.

Figure 4:
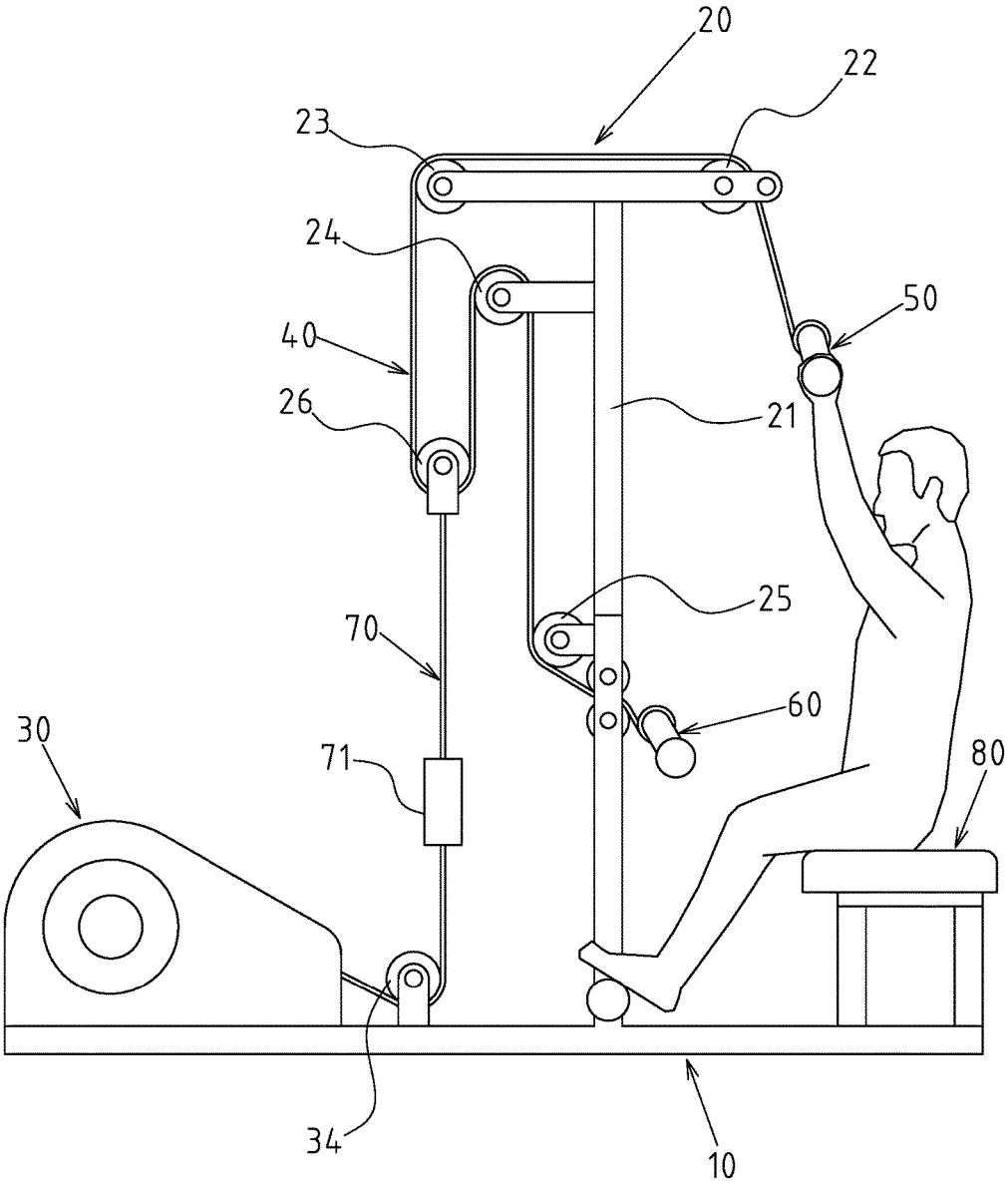
FIG. 4 is a first operational view of the magnetic control exerciser in accordance with the present invention.
Figure 5:
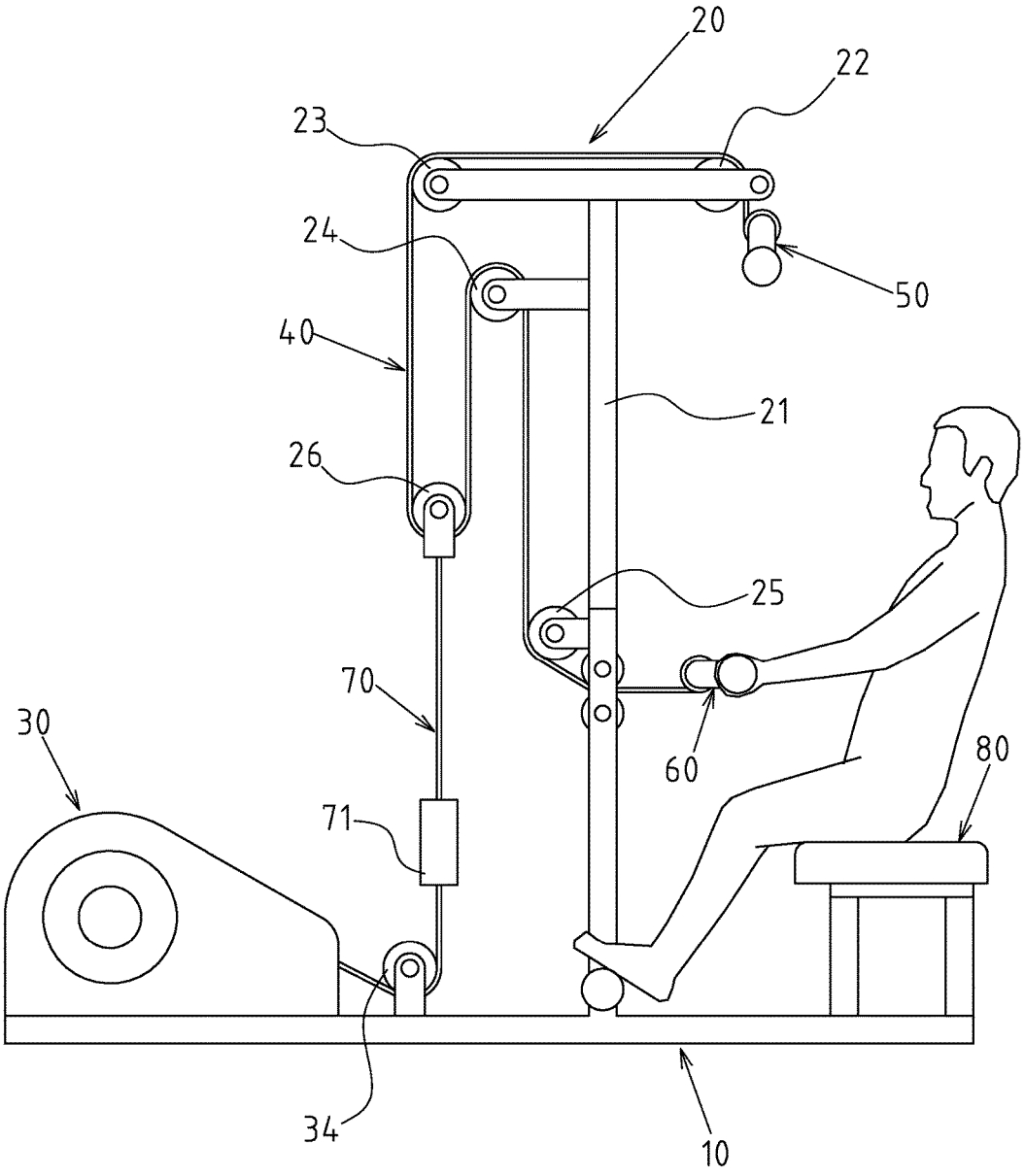
FIG. 5 is a second operational view of the magnetic control exerciser in accordance with the present invention.

With reference to FIG. 4, the user sits on the seat 80 and faces the pulley device 20. The two arms of the user are raised to hold two opposite ends of the first handlebar 50 for pulling the first rope 40 and training his/her upper arms due to a reaction force from the damping device 30. In the is operating mode, the user can also sit on the seat 80 back to the pulley device 20 for training other portion of his/her upper arms. With reference to FIG. 5, the user sits on the seat 80 and faces the pulley device 20, wherein the user leans back to pull the second handlebar 60 for training his/her abdominal muscles. As described above, the magnetic control exerciser in accordance with the present invention is multi-functional.

When pulling the first handlebar 50 or the second handle bar 60, the first rope 40 sequentially upwardly draws the moving pulley 26 and the second rope 40 to sequentially drive the counterweight flywheel 31 rotating with the magnetic wheel 62 via the belt 311 such that the damping device 30 provides a damping effect to the first rope 40 due to the connection between the counterweight flywheel 31 and the magnetic wheel 32. In addition, the rotating counterweight flywheel 31 drives the rope collecting device 35 to pull the resilient member 33 via the rope 312 such that the rope collecting device 35 reversally drives the counterweight flywheel 31 to coil the second rope 70 due to a restitution force of the resilient member 33 when the first handlebar 50/the second handlebar 60 moving to its original position.

Figure 6:
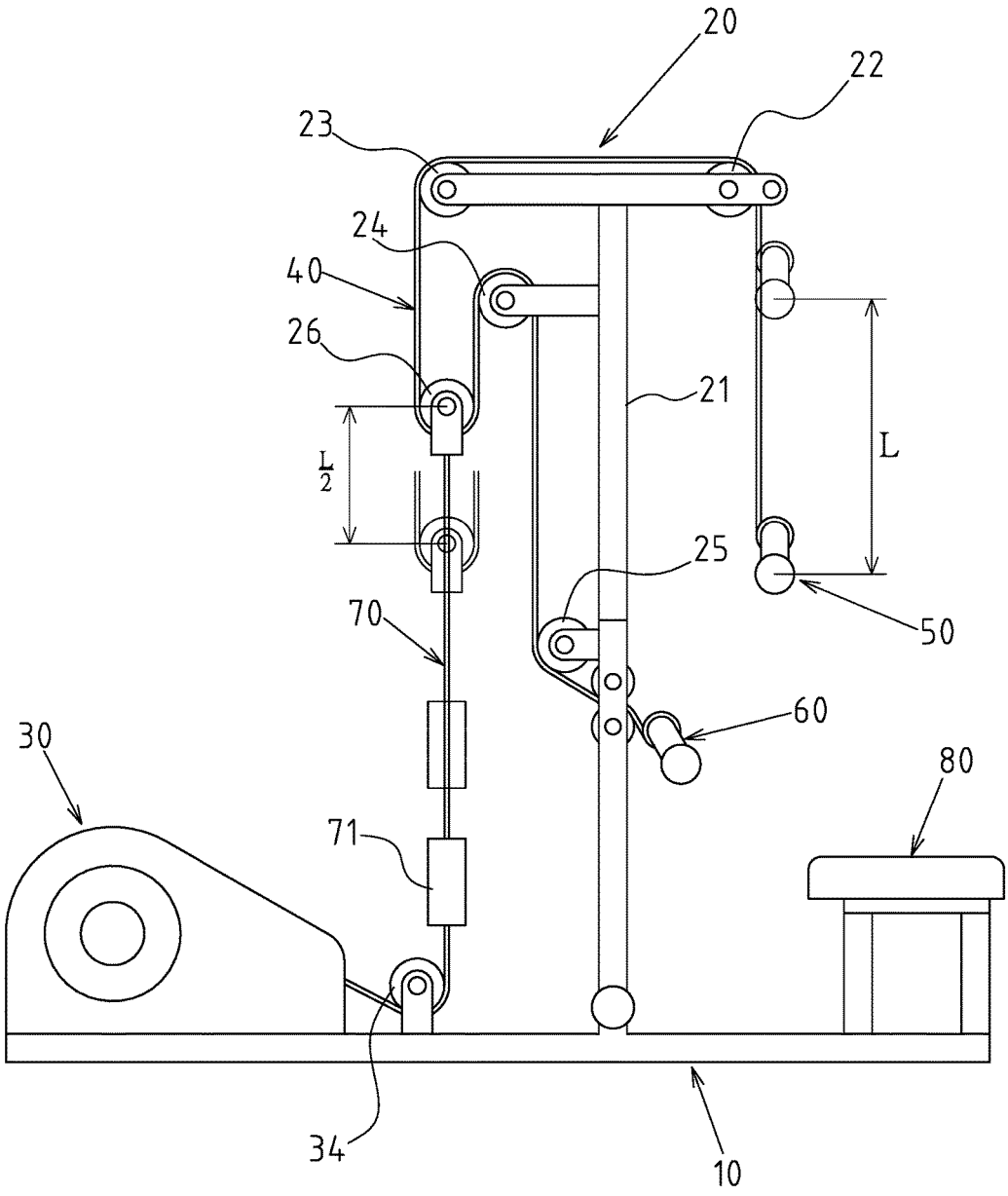
FIG. 6 is a side plan view of the magnetic control exerciser in FIG. 1 for showing the strokes of the moving pulley and the first handlebar.

With reference to FIG. 6, the moving pulley 26 of the pulley device 20 does not reduce the training effect of the magnetic control exerciser in accordance with the present invention when the damping device 30 provides enough damping. The moving pulley 26 of the pulley device 20 is provided to light weight and reduce the cost of the magnetic control exerciser. As shown in FIG. 6, the stroke of the moving pulley 26 is only L/2 when the first handlebar 50 is pulled and has a stroke of L, and the second end of the first rope 40 is fixed due to the second handlebar 60. In the other words, the stroke of the first end of the second rope 70 is L/2 such that the diameters of the counterweight flywheel 31 and the magnetic wheel 32 can be reduced without reducing the training effect of the magnetic control exerciser, and the operating stroke of the magnetic control exerciser is effectively promoted because the stroke of the second rope 70 is halved relative to a conventional exerciser. As a result, the material costs of the counterweight flywheel 31 and the magnetic wheel 32 is downed, and the transport cost is indirectly reduced. Similarly, the operating stroke of the magnetic control exerciser is effectively promoted when pulling the second handlebar 60 and the first end of the first rope 40 being fixed. As described above, with reference to FIGS. 2, 5 and 6, the stroke of the moving pulley 26 is smaller than a distance between the third fixed pulley 24 and the original position of the moving the pulley 26. The counterweight 71 is provided to raise the training effect of the present invention. In addition, the idle first handlebar 50/the second handlebar 60 is moved to its original position by using the gravity of the counterweight 71 and the damping device 30.

With reference to FIGS. 3, 4 and 5, the magnetic control exerciser in accordance with the present invention also provides a rehabilitating function. The damping device 30 provides damping effect only when the first handlebar 50 or the second handlebar 60 is pulled and the magnetic wheel 32 provides no reaction force due to the one-way bearing 321 when the first handlebar 50/the second handlebar 60 is moved toward its original position. The first handlebar 50/the second handlebar 60 is slowly moved to its original position due to the gravity of the counterweight 71, wherein the restitution force of the resilient member 33 drive the counterweight flywheel 31 to collect the released second rope 70.

Although the invention has been explained in relation to its preferred embodiment, it is to be understood that many other possible modifications and variations can be made without departing from the spirit and scope of the invention as hereinafter claimed.

I claim:

1. An exerciser apparatus comprising:

a base;

a damping device disposed on said base, said damping device having an adjustable damping valve;

a rope collecting device positioned in said damping device, said rope collecting device having a coiling force that is less than the damping valve of said damping device;

a main frame affixed to said base and extending upwardly therefrom;

a pulley arrangement disposed on said main frame, said pulley arrangement having a movable pulley;

a first rope extending around said pulley arrangement, said first rope having a first end and a second end, the first end of said first rope having a first handlebar secured thereto, the second end of said first rope having a second handlebar secured thereto, wherein the first handlebar has a height above said base greater than a height of the second handlebar above said base, said damping device causing the first handlebar and the second handlebar to automatically move to a home position when the first handlebar and the second handlebar are not in use; and a second rope connected to the movable pulley and to said damping device, the movable pulley having a length of a stroke that is one-half a length of a stroke of the first handlebar when the first handlebar is moved, the first and second ends of said first rope are fixed relative to the second handlebar.

2. The exercise apparatus of claim 1, further comprising:

a seat secured to said base, said seat adapted to receive a user thereon.

3. The exercise apparatus of claim 2, wherein said main frame is positioned between said seat and said damping device, said pulley arrangement having a first fixed pulley and a second fixed pulley mounted at opposite ends of said top portion of said main frame, said pulley arrangement having a third fixed pulley and a fourth fixed pulley rotatably mounted to a rear side of said main frame, wherein the third fixed pulley and the fourth fixed pulley respectively correspond to the first handlebar and the second handlebar, said first rope sequentially extending over the first fixed pulley, the second fixed pulley, the third fixed pulley, and the fourth fixed pulley, the movable pulley being disposed between the second fixed pulley and the third fixed pulley, said second rope having the first end thereof connected to the movable pulley.

4. The exercise apparatus of claim 3, wherein said pulley arrangement having a fixed pulley disposed on said base, said fixed pulley adapted to change a direction of movement of said second rope.

5. The exercise apparatus of claim 4, wherein said damping device comprising:

a counterweight flywheel rotatably mounted on said base;

a magnetic wheel rotatably mounted to said base; and a resilient member connected to said counterweight flywheel.

6. The exercise apparatus of claim 5, further comprising:

a counterweight affixed to said second rope between the movable pulley and said damping device, wherein said counterweight is positioned between the movable pulley and the fixed pulley.

7. The exercise apparatus of claim 5, wherein the second end of said second rope is secured to said counterweight flywheel and coiled around said counterweight flywheel, said magnetic wheel having a belt connected to said counterweight flywheel such that said magnetic wheel rotates with a rotation of said counterweight flywheel, wherein a rope collecting device is laterally and centrally mounted onto counterweight flywheel, wherein another rope has a first end coiled on said rope collecting device and a second end connector to said resilient member, said magnetic wheel having a one-way bearing centrally mounted therein.

8. The exercise apparatus of claim 2, wherein said pulley arrangement having a fixed pulley disposed on said base, said fixed pulley adapted to change a direction of movement of said second rope.

9. The exercise apparatus of claim 8, wherein said damping device comprising:

a counterweight flywheel rotatably mounted on said base;

a magnetic wheel rotatably mounted to said base; and a resilient member connected to said counterweight flywheel.

10. The exercise apparatus of claim 9, further comprising:

a counterweight affixed to said second rope between the movable pulley and said damping device, wherein said counterweight is positioned between the movable pulley and the fixed pulley.

11. The exercise apparatus of claim 9, wherein the second end of said second rope is secured to said counterweight flywheel and coiled around said counterweight flywheel, said magnetic wheel having a belt connected to said counterweight flywheel such that said magnetic wheel rotates with a rotation of said counterweight flywheel, wherein a rope collecting device is laterally and centrally mounted onto counterweight flywheel, wherein another rope has a first end coiled on said rope collecting device and a second end connector to said resilient member, said magnetic wheel having a one-way bearing centrally mounted therein.

12. The exercise apparatus of claim 1, wherein said pulley arrangement having a fixed pulley disposed on said base, said fixed pulley adapted to change a direction of movement of said second rope.

13. The exercise apparatus of claim 12, wherein said damping device comprising:

a counterweight flywheel rotatably mounted on said base;

a magnetic wheel rotatably mounted to said base; and a resilient member connected to said counterweight flywheel.

14. The exercise apparatus of claim 13, further comprising:

a counterweight affixed to said second rope between the movable pulley and said damping device, wherein said counterweight is positioned between the movable pulley and the fixed pulley.

15. The exercise apparatus of claim 13, wherein the second end of said second rope is secured to said counterweight flywheel and coiled around said counterweight flywheel, said magnetic wheel having a belt connected to said counterweight flywheel such that said magnetic wheel rotates with a rotation of said counterweight flywheel, wherein a rope collecting device is laterally and centrally mounted onto counterweight flywheel, wherein another rope has a first end coiled on said rope collecting device and a second end connector to said resilient member, said magnetic wheel having a one-way bearing centrally mounted therein.

* * * * *